United States Patent [19]

Poma

[11] 4,255,913

[45] Mar. 17, 1981

[54] HOLLOW SLEEVE BRACKETS

[76] Inventor: Frank Poma, 1346 S. Killian Dr., Lake Park, Fla. 33403

[21] Appl. No.: 26,413

[22] Filed: Apr. 2, 1979

[51] Int. Cl.[3] ..... E02D 27/32

[52] U.S. Cl. ..... 52/297; 256/65; 52/707

[58] Field of Search ..... 52/297, 298, 704, 706, 52/707; 256/21, 24, 59, 65, DIG. 6

[56] References Cited

U.S. PATENT DOCUMENTS

| | | | |
|---|---|---|---|
| 1,172,734 | 2/1916 | Raymond | 52/298 |
| 1,284,565 | 11/1918 | Bennett | 52/297 |
| 2,954,638 | 10/1960 | Motter | 256/65 |

FOREIGN PATENT DOCUMENTS

| | | | |
|---|---|---|---|
| 2325483 | 12/1974 | Fed. Rep. of Germany | 52/707 |
| 443980 | 3/1936 | United Kingdom | 52/298 |

*Primary Examiner*—James L. Ridgill, Jr.

[57] ABSTRACT

This disclosure concerns a base receptical for releasably mounting standards for guard chains, and upon removal thereof receive and support decorative modular guard rails. A hollow sleeve bracket member is positioned on reinforcing rods or mesh to receive concrete for walks, verandas, stairs and the like, this hollow sleeve bracket receives a standard having a nut positioned thereon and a bolt extending through said standard and nut to nut to abut the sleeve bracket; and, upon tightening the bolt this temporary standard is firmly positioned in the sleeve bracket. By loosing the bolt the standard can be moved, and a permanent modular guard rail standard of a decorative nature inserted therein. A plurality of these sleeve brackets are preferably connected by one or more rods or rails, which are imbeded in the concrete when poured along with the major portion of the length of the sleeve bracket members.

4 Claims, 4 Drawing Figures

HOLLOW SLEEVE BRACKETS

This invention relates generally to hollow sleeve type brackets to be imbeded in reinforced concrete, verandas, porches, stairways and similar structures of buildings, by which a removable guard chain standard can be releasably secured in the sleeve type bracket; and, upon completion of the building the guard chain standard can be removed from the sleeve bracket; and, a permanent decorative modular guard rail standard secured in said sleeve type bracket imbeded in reinforced concrete.

In the past guard chain standards have been mounted in the reinforced concrete by being clamped thereon. Upon completion they have to be removed and stucco applied to the clamped areas. The permanent guard rail standards are positioned in core drilled holes in the concrete slabs and cemented therein. This is an expensive procedure, a waste of time and provides a guard chain or rail system in which for a part of the construction time they are removed. By the use of the permanent brackets of this invention the guard rails or chains are always in use.

It is therefore a major object of this invention to provide a most effective hollow receptical to successively receive both the guard chain standard and the permanent decorative modular guard rail standard, which will be inexpensive to make and efficient and durable in use.

Referring to the drawinhgs, forming a part hereof, wherein.

Figure 3:
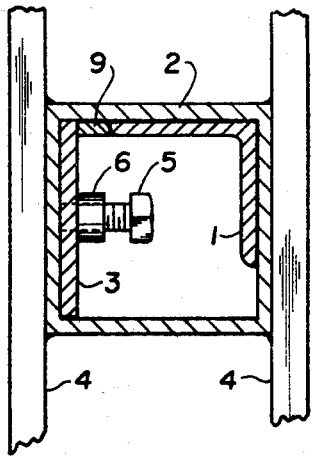
FIG. 3 is a cross sectional view taken along line 3—3 of FIG. 1; and, FIG. 4 is a plan view showing the hollow sleeve brackets with the inter-connecting stringers or runners rigid members connected therewith prior to setting in the concrete slab to be poured.
Figure 4:
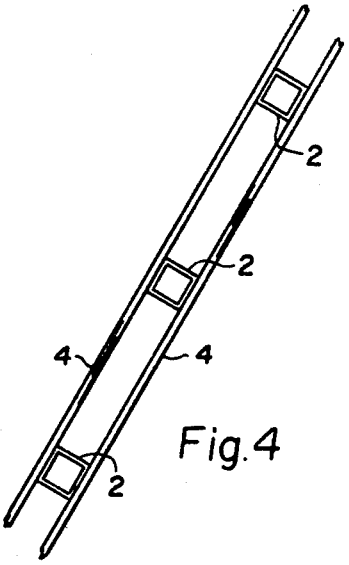
Figure 2:
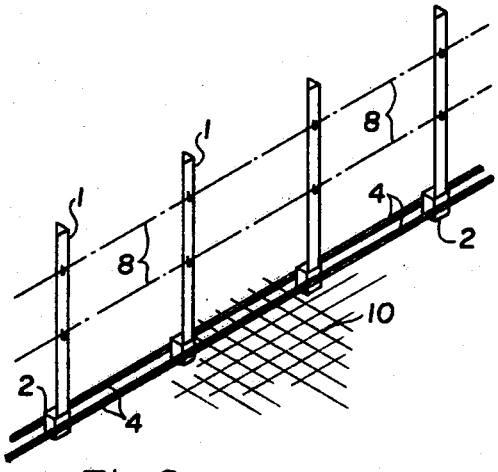
FIG. 2 is an isometric view showing safety guard chains erected in place, with runners or rigid members connecting the sleeve bracket members in the reinforced concrete.
Figure 1:
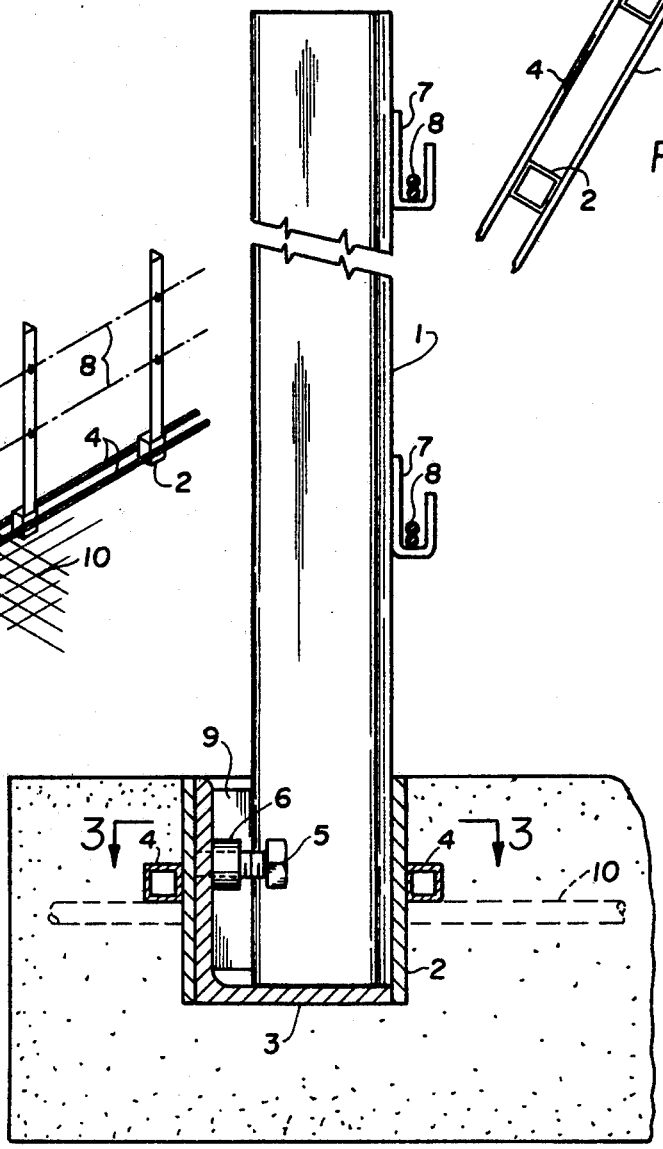
FIG. 1 is a cross sectional view of the sleeve bracket of this invention with a standard for guard chains mounted therein in a reinforced concrete slab.

Referring more specifically to the drawings, a guard chain standard 1, illustrated as an angle member having a solid bottom end plate member substantially rectangular, is slidably mounted in a hollow rectangular sleeve bracket member 2. The angular member 1 has positioned near the bottom solid end thereof and secured thereto an upstanding apertured flange member 3, which is parallel to one of the legs of the angle member 1 and perpendicular to other of said legs to receive a threaded nut 6 secured thereon and aligned with the aperture provided in said flange part 3. The nut 6 and aperture in the flange member 3 receives a threaded bolt 5, which, when tightened, abuts against the face of the hollow sleeve member 2, tightening the standard 1, in the sleeve member 2, firmly securing said standard 1 in the sleeve member 2.

Rigid stringers or runners 4, illustrated as rectangular hollow conduit members, are connected to a plurality of the hollow sleeve bracket members 2, and positioned in the forms for poured reinforced concrete slab with the runners, stringers or conduits 4 resting on the re-enforcing steel mesh or rods 10.

Thereafter the concrete slab is poured to the approximate height of the hollow sleeve bracket 2, leaving a slight projection of the sleeve bracket above the concrete.

U-shaped brackets are positioned on the standards 1 to receive guard chain links 8 which are standard in practice.

In the event that an angle member 1 is employed in which the width of the angle member is less than the cross-sectional length of the sleeve bracket member 2, a filler plate 9 may be welded to a leg member of the angle member 1 and then in turn welded to the projection plate 3 in order that the standard 1 will slide into the hollow sleeve bracket 2 with but little tolerance between them in order that slight tightening of the nut 5 will secure the standard 1 in the sleeve bracket 2.

The invention has been described with respect to hollow rectangular sleeve bracket members 2 and standards in the form of angular members 1, however triangular hollow sleeve members 2 could be used to receive standards having complementary cross-sections and outside dimension approximating that of the inside dimension of the triangular sleeve; and, slidably mountable sleeves and standards having substantially circular cross sections could be used. The rectangular cross sectional sleeve bracket 2 however, has demonstrated the greater strength and also availability, particularly with permanent decorative guard rails.

In operation the device is simple, economical and efficient. The hollow sleeve bracket member 2, with the rigid stringers or runners 4 connected thereto, are positioned on the reinforcing mesh or rods 10; and, the concrete is then poured the approximate height of the hollow bracket member 2. After the cement has set, the temporary guard chain standard 1 is positioned in the hollow sleeve member 2; and, then the bolt 5 is turned in the nut 6 until the end of the bolt is pressing against the side wall of the hollow bracket member 2 thereby firmly positioning the standard 1 in the bracket member 2. Link chains 8 are then inserted in the U shaped brackets 7 to provide a guard chain arrangement. After using, the nut 5 is then loosened so that the guard chain standard 1 can be removed; thereafter, a decorative modular guard rail standard is inserted in the hollow sleeve bracket member 2 and secured thereto in any suitable means, such as non shrinking grout cement.

What is claimed is:

1. A device for releasably mounting a temporary guard chain standard in an open concrete slab, comprising a hollow sleeve bracket member, said hollow sleeve bracket having substantially straight linecross-section design, a guard chain standard having an apertured end portion with opposed members slideably mounted in said hollow sleeve bracket member, a nut secured to said end portion aligned with an apertured end portion, and a bolt extending through said aperture and threaded engaging said nut and abutting said sleeve bracket.

2. A device for releasably mounting a temporary guard chain standard in concrete slab comprising a rectangular hollow sleeve bracket member, a guard chain standard having a closed channel shaped end portion slideably mounted in said sleeve bracket member an aperture in one of said channel sides, a nut positioned over said aperture and secured thereto, and a bolt engaging said nut and abutting the inside surface of said bracket member.

3. The device of claim 2 wherein said sleeve bracket is rectangular in cross section.

4. The device of claim 2 wherein a plurality of sleeve brackets are joined with stringers affixed thereto with the concrete slab.

* * * * *